US006821717B2

(12) United States Patent
Lin et al.

(10) Patent No.: US 6,821,717 B2
(45) Date of Patent: Nov. 23, 2004

(54) PROCESS TO FORM NARROW WRITE TRACK FOR MAGNETIC RECORDING

(75) Inventors: Charles C. Lin, San Jose, CA (US); Kochan Ju, Fremont, CA (US); Jeiwei Chang, Cupertino, CA (US)

(73) Assignee: Headway Technologies, Inc., Milpitas, CA (US)

( * ) Notice: Subject to any disclaimer, the term of this patent is extended or adjusted under 35 U.S.C. 154(b) by 122 days.

(21) Appl. No.: 10/210,955

(22) Filed: Aug. 2, 2002

(65) Prior Publication Data

US 2004/0020778 A1 Feb. 5, 2004

(51) Int. Cl.[7] ..... G11B 5/31

(52) U.S. Cl. ..... 430/320; 430/314; 430/319; 29/603.07

(58) Field of Search ..... 430/320, 322, 430/324, 319, 314; 29/603.07, 603.13, 603.18; 360/126

(56) References Cited

U.S. PATENT DOCUMENTS

| | | | | |
|---|---|---|---|---|
| 5,809,637 | A | 9/1998 | Rottmayer | 29/603.15 |
| 6,178,065 | B1 | 1/2001 | Terunuma et al. | 360/126 |
| 6,289,578 | B1 | 9/2001 | Kamijima | 29/603.14 |
| 6,303,392 | B1 | 10/2001 | Matsukuma | 438/3 |
| 6,328,859 | B1 | 12/2001 | Hsiao et al. | 204/192.34 |
| 6,641,984 | B2 * | 11/2003 | Kamijima | 430/320 |

FOREIGN PATENT DOCUMENTS

WO WO99/41739 * 8/1999

OTHER PUBLICATIONS

English language translation of WO 99/41739, Aug. 1999.*

* cited by examiner

*Primary Examiner*—John A. McPherson
(74) *Attorney, Agent, or Firm*—George O. Saile; Stephen B. Ackelman

(57) ABSTRACT

As the recording density of magnetic disk drives approaches 100 Gbits/in$^2$, write track lengths of about 0.10 microns will be required. This cannot be accomplished using conventional photolithography. The present invention solves this problem by first forming on the bottom pole of the write head a cavity in a layer of photoresist, using conventional means. A seed layer of non-magnetic material is electrolessly laid down, following which a second layer of photoresist is deposited and patterned to form a second cavity that symmetrically surrounds the first one, thereby forming a mold around it. Ferromagnetic metal is then electrodeposited in this mold to form the top magnetic pole. Following the removal of all photoresist and a brief selective etch of the bottom pole, an extremely narrow write head is obtained.

35 Claims, 3 Drawing Sheets

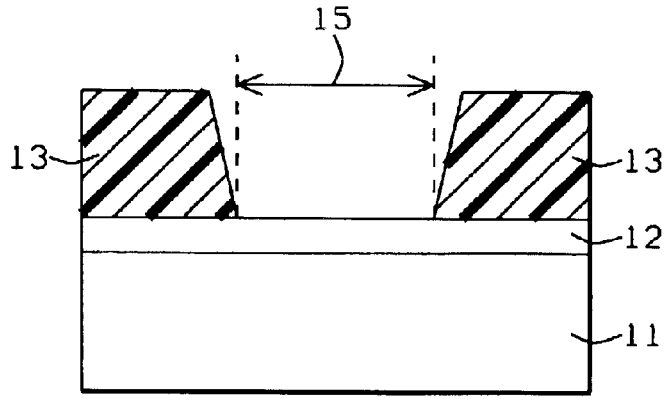
FIG. 1 – Prior Art
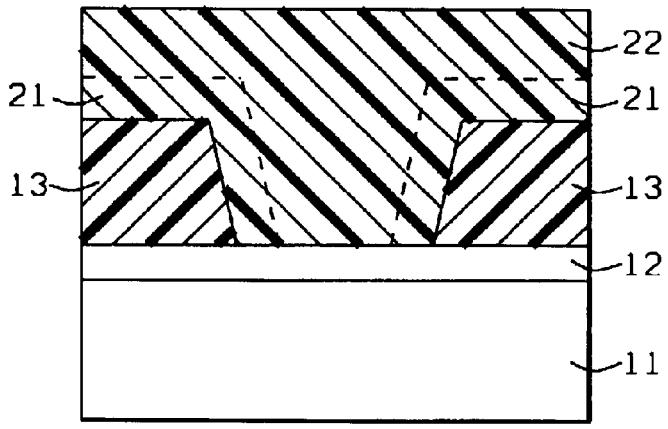
FIG. 2 – Prior Art
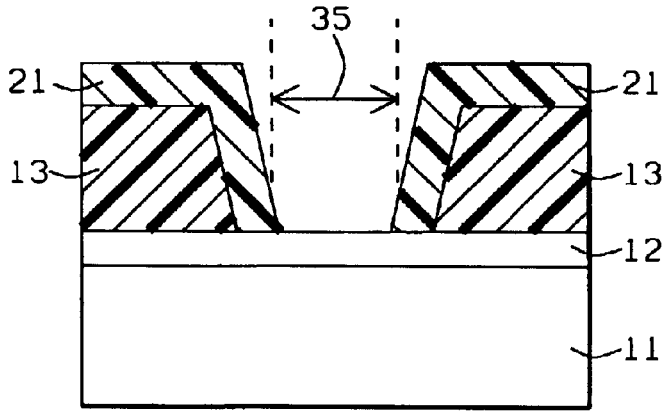
FIG. 3 – Prior Art

PROCESS TO FORM NARROW WRITE TRACK FOR MAGNETIC RECORDING

FIELD OF THE INVENTION

The invention relates to the general field of magnetic disk recording with particular reference to write heads.

BACKGROUND OF THE INVENTION

As the recording density of magnetic disk drives has been pushed to beyond 50 Gbits/in$^2$, it has become essential to be able to manufacture extremely small features. These densities require the read and write element widths to be smaller than 0.15 and 0.20 microns, respectively. At 100 Gbits/in$^2$, their width will be even smaller, approximately 0.10 and 0.13 microns. Conventional photolithography is quickly running out of its capability to handle such small dimensions.

While other technique such as E beam lithography are being developed to meet the challenge, an approach that does not require a radical change in the imaging system is to be preferred. For example, the "RELACS" process has been developed to achieve small write head dimensions. This process is in two steps. First, as shown in FIG. 1, substrate 11 (which will serve as the bottom pole) is coated with non-magnetic write gap layer 12. Photoresist layer 13 is then laid down and patterned to form an opening whose width 15 is greater than the intended final width. Then, second photoresist layer 22 is laid down, as shown in FIG. 2, followed by a baking step. This initiates cross linking to begin at the resist 13/resist 22 interface. As long as heat is supplied, cross linking continues, moving outwards from the original interface into the bulk of resist 22.

By controlling the bake time, the thickness of cross linked layer 21 can be controlled so that, when the resist is developed, layer 21 remains and, as seen in FIG. 3, a new opening having a lesser width 35 has been formed.

In practice, the rate at which the cross linked layer grows depends, not just on bake time and temperature, but also on other parameters such as development history, impurity content, etc. so can be more difficult to control than the above description might suggest. The present invention takes a different approach to solving this problem, as we will disclose below.

A routine search of the prior art was performed with the following references of interest being found:

In U.S. Pat. No. 6,289,578 B1, Kamijima shows a write head process/structure without using a dry etch process. Rottmayer, in U.S. Pat. No. 5,809,637, discloses a method to make a magnetic head assembly with a write Pole/shield structure while Matsukuma (U.S. Pat. No. 6,303,392 B1) shows an etch process for making write poles. U.S. Pat. No. 6,328,859 B1 (Hsiao et al.) discloses a method for making pole tips and U.S. Pat. No. 6,178,065 B1 (Terunuma et al.) shows a related patent including a write head process.

SUMMARY OF THE INVENTION

It has been an object of at least one embodiment of the present invention to provide a process for forming a write head for use in a magnetic disk storage system.

Another object of at least one embodiment of the present invention has been that said process be compatible with existing optical photolithography.

Still another object of at least one embodiment of the present invention has been that said write head have a track length that is no greater than about 0.2 microns.

A further object of at least one embodiment of the present invention has been that said process be applicable to any structure that requires a very narrow mid-section.

These objects have been achieved by first forming on the bottom pole of the write head a cavity in a layer of photoresist, using conventional means. A seed layer of non-magnetic material is electrolessly laid down, following which a second layer of photoresist is deposited and patterned to form a second cavity that symmetrically surrounds the first one, thereby forming a mold around it. Ferromagnetic metal is then electro-deposited in this mold to form the top magnetic pole. Following the removal of all photoresist and a brief selective etch of the bottom pole, an extremely narrow write head is obtained.

BRIEF DESCRIPTION OF THE DRAWINGS

FIGS. 1–3 illustrate a prior art process for forming a very narrow gap.

DESCRIPTION OF THE PREFERRED EMBODIMENTS

We will disclose the present invention through a description of the process for manufacturing a magnetic write head having an extremely narrow track width. It will, however, be understood that the invention is more general than this and could be applied to any situation (such as formation of a MEMS structure) where a body having a very narrow mid-section is required.

Figure 4:
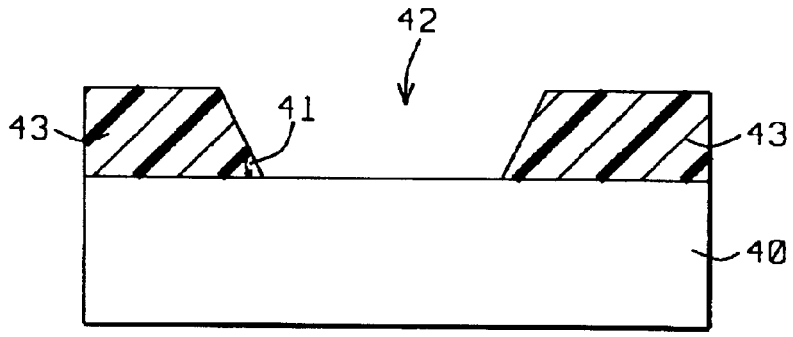
FIG. 4 shows the starting point for the process of the present invention.

Referring now to FIG. 4, the process begins with the provision of bottom magnetic pole 40 on whose upper surface photoresist layer 43 is laid down. Layer 43 is typically between about 0.2 and 1 microns thick, with about 0.5 microns being preferred. Standard photolithographic techniques are used to pattern it so as to form opening 42 which will define a width that is larger than the intended write track width. It is, however, important that the angle 41 made between the resist and the substrate surface be controlled. This was ensured through control of exposure energy and time, developer strength and developing time, and baking temperature and time. An important feature of the present invention is that angle 41 may be relatively large (see later). By using these constraints during the lithographic process, the angle of slope of the opening's walls was maintained to be between about 70 and 90 degrees.

Figure 5:
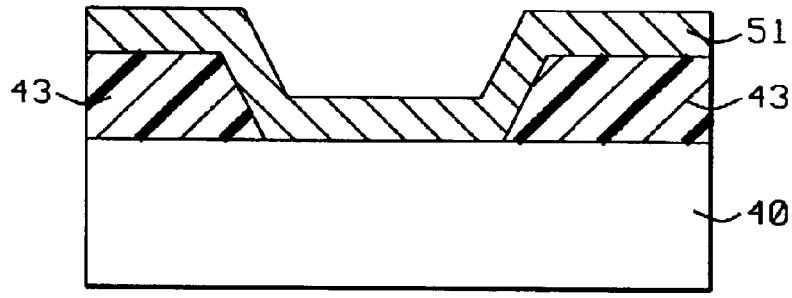
FIG. 5 shows the formation of the non-magnetic write gap.

Next, as seen in FIG. 5, layer 51 of a conductive non-magnetic material is deposited using an electroless process. Layer 51 may be used as a seed (between about 0.04 and 0.15 microns thick) onto which additional non-magnetic material is deposited (not shown) or the electroless deposit may be allowed to grow to the full thickness required for layer 51 (between about 0.04 and 0.15 microns). A typical material suitable for layer 51 is NiP containing 10 to 14 atomic percent of phosphorus.

Figure 6:
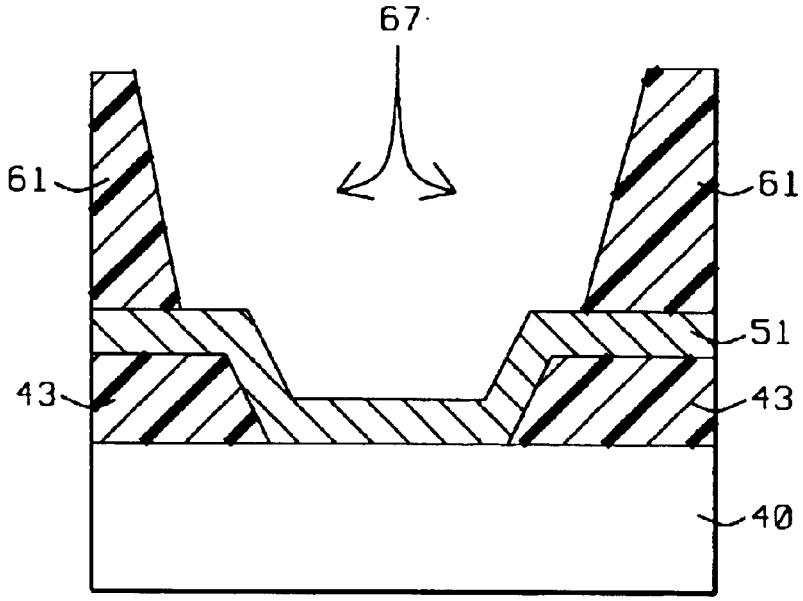
FIG. 6 shows formation of a photoresist mold around the gap seen in FIG. 5.

The next step is shown in FIG. 6. A second layer of photoresist 61 is now deposited on layer 51 and then patterned to form a second opening 67 that is uniformly wider than opening 42 as well as being symmetrically disposed around it.

Figure 7:
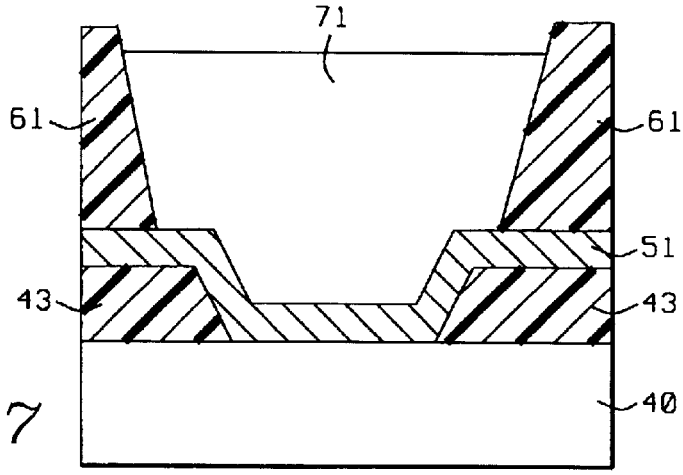
FIG. 7 shows the mold of FIG. 6 after it has been filled with electroplated ferromagnetic material.

Then, as shown in FIG. 7, layer of ferromagnetic metal 71, having (after deposition) a magnetic moment of at least 10,000 gauss, is electrodeposited, inside opening 67 on layer 51, to a thickness that is less than the depth of opening 67, typically between about 0.5 and 5 microns. Suitable materials for layer 71 include CoNiFe, CoFe, NiFe, and CoFeV.

Figure 8:
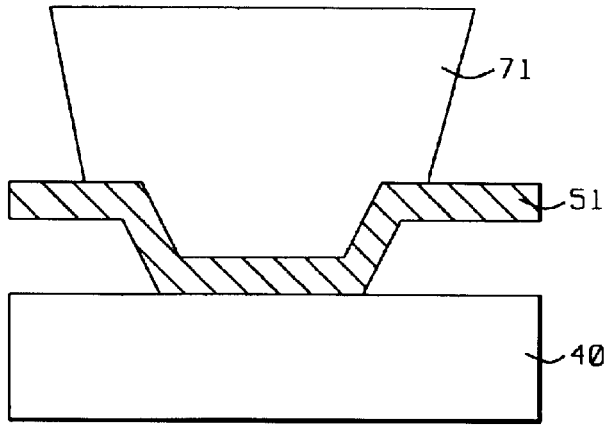
FIG. 8 shows the structure after all photoresist has been removed.
Figure 9:
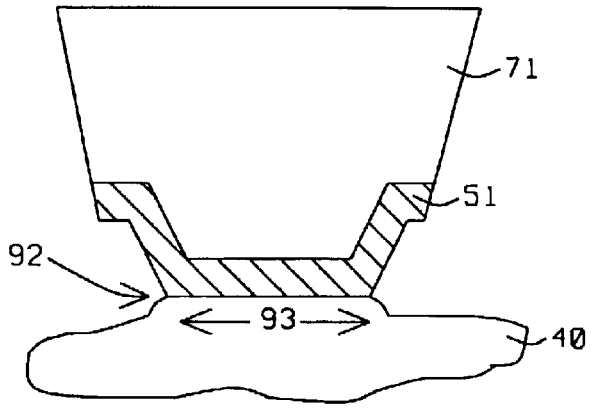
FIG. 9 shows the structure obtained at the conclusion of the process.

All photoresist is then removed, giving the structure the appearance shown in FIG. 8, together with any of layer 51 that is not in contact with a surface. The process concludes with a brief etch that selectively removes a small amount off the top of substrate 40. This results in the formation of the narrow mid-section 92 as seen in FIG. 9. The portion of layer 51 immediately above 92 can now serve as the non-magnetic write gap that determines the length 93 of the write track. Using this processes, write track lengths less than about 0.1 microns have been achieved.

What is claimed is:

1. A process to manufacture a body having a narrow mid-section, comprising:

providing a part having an upper surface and coating said surface with a first layer of photoresist, having a first thickness, and then patterning said photoresist to form therein a first opening having interior walls that slope at an angle relative to said upper surface;

by means of an electroless process, depositing a layer of conductive material, thereby forming a seed layer that covers all exposed surfaces;

electrodepositing a first layer of metal on said seed layer;

on said first metal layer, depositing and then patterning a second layer of photoresist, to a second thickness, to form a second opening that is uniformly wider than said first opening and that is symmetrically disposed around said first opening;

in said second opening, electrodepositing a layer of magnetic material on said first metal layer to a third thickness that is less than said second thickness;

then removing all photoresist as well as any of said seed and first metal layers that are not in contact with a surface; and then selectively removing an amount of said upper surface, thereby forming said narrow mid-section.

2. The process described in claim 1 wherein said first photoresist thickness is between about 0.1 and 1 microns.

3. The process described in claim 1 wherein said first opening has a maximum width that is less than about 0.25 microns.

4. The process described in claim 1 wherein said angle of slope, relative to said upper surface, of said interior walls is between about 70 and 90 degrees.

5. The process described in claim 4 wherein said first photoresist layer was formed by controlling process variables selected from the group consisting of exposure energy, exposure time, developer strength, developing time, baking temperature, and baking time.

6. The process described in claim 1 wherein said seed layer is NiP having a phosphorous content of between 10 and 14 atomic percent.

7. The process described in claim 1 wherein said seed layer is deposited to a thickness between about 0.14 and 0.16 microns.

8. The process described in claim 1 wherein said first layer of metal is selected from the group consisting of Cu, Au, Ag, and NiCu.

9. The process described in claim 1 wherein said first metal layer is deposited to a total thickness between about 0.04 and 0.16 microns.

10. The process described in claim 1 wherein said layer of magnetic material is selected from the group consisting of CoNiFe, CoFe, NiFe, and CoFeV.

11. The process described in claim 1 wherein said second layer of magnetic material is deposited to a thickness between about 0.5 and 4 microns.

12. A process to manufacture a body having a narrow mid-section, comprising:

providing a part having an upper surface and coating said surface with a first layer of photoresist, having a first thickness, and then patterning said photoresist to form therein a first opening having interior walls that slope at an angle relative to said upper surface;

by means of an electroless process, depositing a first conductive layer that covers all exposed surfaces;

on said first conductive layer, depositing and then patterning a second layer of photoresist, to a second thickness, to form a second opening that is uniformly wider than said first opening and that is symmetrically disposed around said first opening;

in said second opening, electrodepositing a ferromagnetic layer on said first conductive layer to a thickness that is less than said second thickness;

then removing all photoresist as well as any of said first conductive layer that is not in contact with a surface; and then selectively removing an amount of said upper surface, thereby forming said narrow mid-section.

13. The process described in claim 12 wherein said first opening has a maximum width that is less than about 0.25 microns.

14. The process described in claim 12 wherein said first layer of metal is NiP having a phosphorous content of between 10 and 14 atomic percent.

15. The process described in claim 12 wherein said first metal layer is deposited to a thickness between about 0.04 and 0.16 microns.

16. A process to manufacture a magnetic write head, comprising:

providing a bottom magnetic pole having an upper surface and coating said surface with a first layer of photoresist, having a first thickness, and then patterning said photoresist to form a first opening that defines a wider than intended write track and that has interior walls that slope at an angle relative to said upper surface;

by means of an electroless process, depositing a layer of conductive non-magnetic material, thereby forming a seed layer that covers all exposed surfaces;

electrodepositing a layer of non-magnetic metal on said seed layer;

on said first metal layer, depositing and then patterning a second layer of photoresist, to a second thickness, to form a second opening that is uniformly wider than said first opening and that is symmetrically disposed around said first opening;

in said second opening, electrodepositing a layer of ferromagnetic metal on said non-magnetic metal layer, to a thickness that is less than said second thickness;

then removing all photoresist as well as any of said seed and non-magnetic metal layers that are not in contact with a surface; and then selectively removing an amount of said upper surface, thereby forming said write head.

17. The process described in claim 16 wherein said first photoresist thickness is between about 0.1 and 1 microns.

18. The process described in claim 16 wherein said write track has a maximum length that is less than about 0.25 microns.

19. The process described in claim 16 wherein said angle of slope, relative to said upper surface, of said interior walls is between about 70 and 90 degrees.

20. The process described in claim 19 wherein said first photoresist layer was formed by controlling process variables selected from the group consisting of exposure energy, exposure time, developer strength, developing time, baking temperature, and baking time.

21. The process described in claim 16 wherein said seed layer is NiP having a phosphorous content of between 10 and 14 atomic percent.

22. The process described in claim 16 wherein said seed layer is deposited to a thickness between about 0.04 and 0.16 microns.

23. The process described in claim 16 wherein said ferromagnetic layer has a magnetic moment of at least 10,000 gauss.

24. The process described in claim 16 wherein said non-magnetic layer is selected from the group consisting of Cu, Au, Ag, and NiCu.

25. The process described in claim 16 wherein said non-magnetic layer is deposited to a thickness between about 0.04 and 0.16 microns.

26. The process described in claim 16 wherein said ferromagnetic layer is selected from the group consisting of CoNiFe, CoFe, NiFe, and CoFeV.

27. The process described in claim 16 wherein said ferromagnetic layer is deposited to a thickness between about 0.5 and 4 microns.

28. A process to manufacture a magnetic write head, comprising:

providing a bottom magnetic pole having an upper surface and coating said surface with a first layer of photoresist, having a first thickness, and then patterning said photoresist to form a first opening having interior walls that slope at an angle relative to said upper surface;

by means of an electroless process, depositing a non-magnetic layer that covers all exposed surfaces;

on said non-magnetic layer, depositing and then patterning a second layer of photoresist, to a second thickness, to form a second opening that is uniformly wider than said first opening and that is symmetrically disposed around said first opening;

in said second opening, electrodepositing a layer of a ferromagnetic material on said non-magnetic layer to a thickness that is less than said second thickness;

then removing all photoresist as well as any of said non-magnetic layer that is not in contact with a surface; and then selectively removing an amount of said upper surface, thereby forming said magnetic write head.

29. The process described in claim 28 wherein said angle of slope, relative to said upper surface, of said interior walls is between about 70 and 90 degrees.

30. The process described in claim 29 wherein said first photoresist layer was formed by controlling process variables selected from the group consisting of exposure energy, exposure time, developer strength, developing time, baking temperature, and baking time.

31. The process described in claim 28 wherein said ferromagnetic layer has a magnetic moment of at least 10,000 gauss.

32. The process described in claim 28 wherein said non-magnetic layer is NiP having a phosphorous content of between 10 and 14 atomic percent.

33. The process described in claim 28 wherein said non-magnetic layer is deposited to a thickness between about 0.04 and 0.16 microns.

34. The process described in claim 28 wherein said ferromagnetic layer is selected from the group consisting of CoNiFe, CoFe, NiFe, and CoFeV.

35. The process described in claim 28 wherein said ferromagnetic layer is deposited to a thickness between about 0.5 and 4 microns.

* * * * *